United States Patent [19]

Yoshida et al.

[11] Patent Number: 4,524,254

[45] Date of Patent: Jun. 18, 1985

[54] PRESSURE SWITCH

[75] Inventors: Hatsuyoshi Yoshida; Michio Fukutome, both of Aichi; Makoto Ohuchi; Jyun Ohta, both of Toyota, all of Japan

[73] Assignees: Kabushiki Kaisha Tokai Rika Denki Seisakusho, Oguchi; Toyota Jidosha Kabushiki Kaisha, Toyota, both of Japan

[21] Appl. No.: 551,030

[22] Filed: Nov. 14, 1983

[30] Foreign Application Priority Data

Nov. 17, 1982 [JP] Japan ..... 57-174161[U]

[51] Int. Cl.[3] ..... H01H 35/40; H01H 9/02

[52] U.S. Cl. ..... 200/83 R; 200/83 W; 200/306

[58] Field of Search ..... 200/83 R, 83 W, 306

[56] References Cited

U.S. PATENT DOCUMENTS

| | | | |
|---|---|---|---|
| 2,685,650 | 8/1954 | Collins et al. | 200/83 W X |
| 2,698,887 | 1/1955 | Shaw | 200/83 W |
| 2,945,430 | 7/1960 | Slick | 200/306 X |
| 3,090,848 | 5/1963 | Scholz | 200/83 W |
| 3,898,421 | 8/1975 | Suzumura | 200/306 X |

FOREIGN PATENT DOCUMENTS 56-54725 5/1981 Japan .

*Primary Examiner*—J. R. Scott

*Attorney, Agent, or Firm*—Oblon, Fisher, Spivak, McClelland & Maier

[57] ABSTRACT

A pressure switch including a diaphragm displaceable under pressure and a switch chamber containing a switch element responsive to the displacement of the diaphragm, the switch chamber further including a vent hole formed therein for communicating said switch chamber with the surrounding atmosphere, the vent hole being closed at one end by a porous filter having air permeability and water repellency, the filter extending outwardly from the surrounding walls of a holder.

3 Claims, 1 Drawing Figure

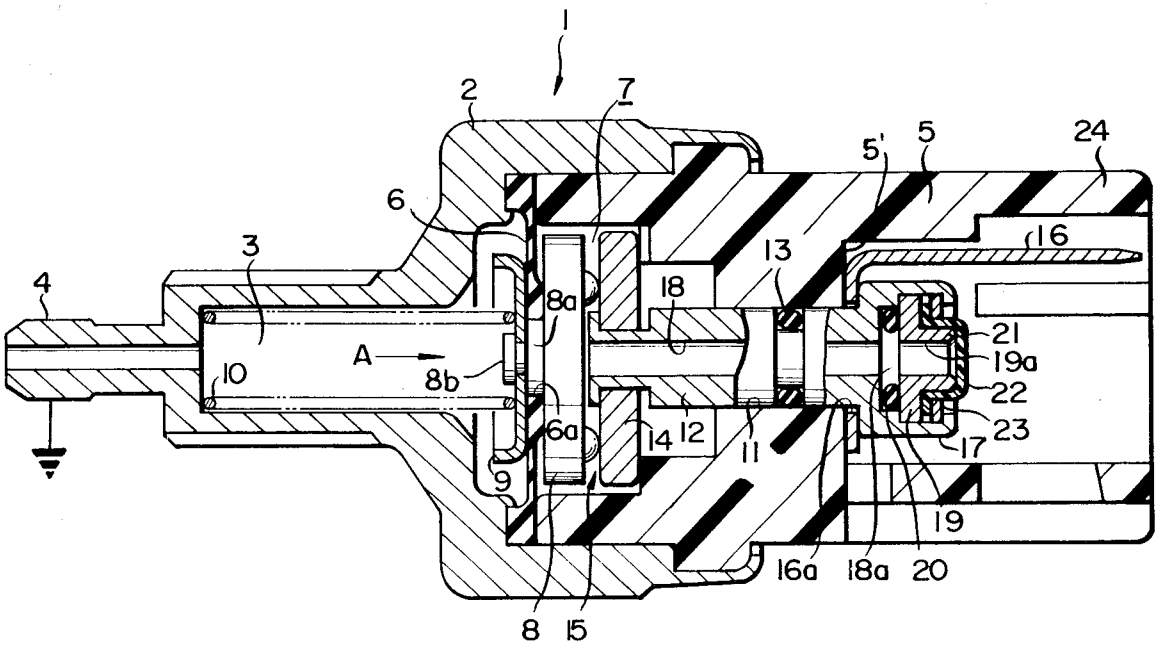
24
16
5
5'
21
19a
22
23
17
19
20
18a
16a
13
11
12
14
18
7
1
8a
6a
15
8
2
6
9
8b
A
3
10
4

PRESSURE SWITCH

BACKGROUND OF THE INVENTION

1. Field of the Invention

The present invention relates to a pressure switch comprising a diaphragm displaceable under pressure and a switch element responsive to the displacement of the diaphragm.

2. Description of Prior Art

There are known various pressure switch systems for vehicles. Japanese Laid-open Patent Application No. 56-54725 discloses one of these pressure switch systems which comprises a diaphragm displaceable under pressure, a movable contact responsive to the displacement of the diaphragm and a stationary contact co-operating with the movable contact to generate an electrical signal. Such a pressure switch system can relatively simply sense the variations in pressure and is particularly suitable for use in the vehicle engine as a negative pressure detection switch or the like. However, the use of a diaphragm requires a communicating opening formed in the switch body and which raises such a problem that moisture or external matters may enter the interior of the switch through the above communicating opening.

In the prior art switch system, moisture is prevented from entering the pressure chamber of the switch adjacent a pressure line by the use of a waterproof cap mounted thereon. However, the switch chamber of the system in the side opposite to the pressure chamber includes no waterproof means. Thus, the prior art switch system is disadvantageous in that the penetration of waterdrops causes the contacts to degrade in electrical conductivity, and so forth.

SUMMARY OF THE INVENTION

It is therefore an object of the present invention to provide a pressure switch which can prevent the switch chamber thereof from being entered by moisture and also which can possitively be actuated by a preset pressure by effectively suppressing the change of pressure in the switch chamber through the communicating opening in the switch chamber without exceeding a predetermined value.

In order to accomplish the above object, the present invention provides a pressure switch comprising a diaphragm displaceable under pressure and a switch chamber containing a switch element responsive to the displacement of the diaphragm, the switch chamber further including a vent hole formed therein for communicating said chamber with the surrounding atmosphere, the pressure switch being characterized by said vent hole is closed at one end by a porous filter having air permeability and water repellency, said filter extending outwardly from the surrounding walls.

BRIEF DESCRIPTION OF THE SOLE FIGURE

A sole FIGURE is a longitudinal cross-section of a pressure switch which is one embodiment of the present invention.

DETAILED DESCRIPTION OF THE PREFERRED EMBODIMENT

Referring to the drawing, a pressure switch 1 according to the present invention comprises a metallic body 2 which includes a vacuum chamber 3 and a tube fitting 4 connecting with the vacuum chamber 3. The body 2 is clamped on a plastic insulator 5 having a shoulder 5' to compress the marginal portion of a diaphragm 6 therebetween so that the vacuum chamber 3 will be closed at one end by the diaphragm 6. The insulator 5 includes a switch chamber 7 formed therein at the end opposed to the diaphragm 6.

The central portion of the diaphragm 6 is held between a movable contact 8 with a rivet member **8*b* and an inner plate 9. The movable contact 8 includes a stem 8*a* extending therefrom through the central opening 6*a* of the diaphragm 6. The tip of the stem 8*a* is clamped on the inner plate 9**.

A coil spring 10 is mounted in the vacuum chamber 3 to bias the inner plate 9 and thus the diaphragm 6 in the direction of arrow as shown by A in the drawing.

The insulator 5 includes a bore 11 formed therethrough and which communicates with the switch chamber 7. The bore 11 receives a cylindrical vent member 12 of metal. An O-ring 13 is sealingly located between the inner wall of the bore 11 and the reduced diameter of the vent member 12.

A stationary contact 14 is located within the switch chamber 7 and clamped on the vent member 12 at the inner end thereof. The stationary contact 14 cooperates with the movable contact 8 to provide a switch element 15. When the vacuum chamber 3 is under atmosphere, the movable contact 8 is in contact with the stationary contact 14 under the force of the coil spring 10.

There is a connector terminal 16 of substantially L-shape which includes a mounting aperture **16*a* formed therethrough at one leg. The vent member 12 extends through the mounting aperture 16*a* to fixedly locate the connector terminal 16 within the insulator 5 between the enlarged end 17 of the vent member 12 and the inner shoulder of the insulator 5**.

The vent member 12 includes a vent hole 18 formed therethrough and a stepped hole **18*a* formed therein at the enlarged end 17 of the vent member 12. The stepped hole 18*a* receives an O-ring 20 at the inner end and also a holder 19 engaging the intermediate step thereof. The holder 19 includes a vent hole 19*a* formed therethrough to communicate with the vent hole 18 of the vent member 12. The holder 19 also includes an annular extension 21 formed therein at the outer end to surround the vent hole 19*a***.

A porous filter 22 having air permeability and water repellency is mounted on the annular extension 21 of the holder 19 at the outer end thereof to close the vent hole **19*a*. The filter 22 is made of a porous film of tetra fluoro ethylene resin as sold under the trademark "TEFLON" or "GORE-TEX" (porous tetra fluoro ethylene resin), for example. The marginal portion of the filter 22 is held between the outer end face of the holder 19 and a flat washer 23 which is clampedly mounted in the enlarged end 17 of the vent member 12**.

The insulator 5 includes a connector guide 24 formed integrally therein for guiding a connector (not shown) which is to be connected with the connector terminal 16.

The tube fitting 4 of the switch body 2 is to be connected with a tube communicating with a source of vacuum. The switch body 2 is fixedly secured and grounded to the vehicle body or the like. When the vacuum chamber 3 is under atmosphere pressure and if the movable contact 8 is in contact with the stationary contact 14, the connector terminal 16 is grounded through the vent member 12, stationary contact 14, movable contact 8, inner plate 9, coil spring 10 and body 2 in the order described. If the vacuum chamber 3 is operatively connected with the source of vacuum and then placed under a predetermined negative pressure, the diaphragm 6 is displaced in the opposite direction of arrow A against the force of the coil spring 10 so that the movable contact 8 will be moved away from the stationary contact 14 to open the switch element 15. As the switch chamber 7 is varied in volume in response to the displacement of the diaphragm 6, air enters or exits from the switch chamber 7 through the vent holes 18 and 19*a* and the filter 22 in response to the variations of volume in the switch chamber. As a result, the switch chamber 7 is continuously maintained with an internal pressure equal to atmosphere. Therefore, displacement of the diaphragm 6 will directly be proportional to the negative pressure in the vacuum chamber 3 so that the switch element 15 can be actuated under the preselected negative pressure without delay.

As described above, the holder 19 is provided with the annular extension 21 which surrounds the vent hole 19*a* and is closed by the filter 22. The filter 22 is disposed at a position spaced outwardly away from the flat washer 23. In such an arrangement, therefore, if moisture contacts the surface of the filter 22, it will immediately be repelled therefrom by the water repellency of the filter 22. If moisture should contact the filter surface to form waterdrops thereon, the air permeability of the filter 22 would adversely be affected. As a result, the pressure within the switch chamber 7 will be varied from a negative value to a positive value and vice versa to preclude the smooth displacement of the diaphragm 6 when the latter is displaced under the variations of negative pressure so that the switch element 15 may be actuated under a pressure different from the preselected negative pressure or with delay. Since no moisture will be accumulated on the surface of the filter 22 in the pressure switch according to the present invention, the switch element 15 can possitively be actuated under the desired negative pressure. Furthermore, no moisture will enter the switch chamber 7.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A pressure switch, comprising:

a pressure switch body having a switch chamber; a diaphragm housed in said body so as to be displaceable under pressure;

a switch element located in said switch chamber responsive to displacement of the diaphragm, said switch element further including a cylindrical vent member having an enlarged end and further including a first vent hole formed therein for communicating said switch chamber with the surrounding atmosphere;

a contact mounted in said body;

a holder having a second vent hole in communication with said first vent hole, said holder mounted in said enlarged end of said cylindrical vent member;

a stationary contact mounted on said cylindrical vent member for being contacted by said contact mounted in said body;

a porous filter for closing said second vent hole at one end via said porous filter, said porous filter being air permeable and water repellent and extending outwardly from surrounding walls of said holder; and a washer positioned between said filter and said enlarged end of said cylindrical vent member such that said filter is spaced outwardly from said washer.

2. A pressure switch as defined in claim 1, further comprising an insulator wherein said vent member is fixedly mounted on said insulator and wherein said holder is inserted into the open end of said cylindrical vent member, said holder including an annular extension formed therein to surround said second vent hole and on which said porous filter is mounted.

3. A pressure switch as defined in claim 1 wherein said porous filter further comprises a porous film.

* * * * *